US007051567B2

(12) United States Patent
Lu

(10) Patent No.: US 7,051,567 B2
(45) Date of Patent: May 30, 2006

(54) METHOD FOR FOLDING AND CURVING OF A METALLIC PLATE

(75) Inventor: Jin-Chu Lu, Taipei (TW)

(73) Assignee: Tieh Chin Kung Metal Industry Co., Ltd., Taipei (TW)

( * ) Notice: Subject to any disclaimer, the term of this patent is extended or adjusted under 35 U.S.C. 154(b) by 122 days.

(21) Appl. No.: 10/919,235

(22) Filed: Aug. 17, 2004

(65) Prior Publication Data

US 2006/0037378 A1 Feb. 23, 2006

(51) Int. Cl.
*B21D 31/00* (2006.01)

(52) U.S. Cl. ..... 72/379.2

(58) Field of Classification Search ..... 73/379.2, 73/389.1, 389.3, 701, 702, 379.4, 379.6, 73/389.6, 51, 368; 29/897.3, 469.5, 897.32; 428/595; 72/51, 368

See application file for complete search history.

(56) References Cited

U.S. PATENT DOCUMENTS 652,658 A * 6/1900 Bischoff ..... 72/368
846,139 A * 3/1907 Pruden ..... 72/379.2
3,681,994 A * 8/1972 Zbornik ..... 72/389.3
4,309,890 A * 1/1982 Ichikawa et al. ..... 72/368
5,408,858 A * 4/1995 Fukuda ..... 72/389.6
6,098,435 A * 8/2000 Takada ..... 72/31.11

* cited by examiner

*Primary Examiner*—Derris H. Banks
*Assistant Examiner*—Teresa M. Bonk

(74) *Attorney, Agent, or Firm*—Rosenberg, Klein & Lee

(57) ABSTRACT

A metallic plate is curved and folded by means of a press such that a curved portion is formed along an edge thereof, and two opposing straight portions are parallel, which are on two sides of the curved portion; the press includes first and second lower dies, and first and second hydraulic actuated upper dies; the first lower die has notches along it; the second lower die has a trench along it, whose cross-section is like an U; the second upper die has a pressing portion fitting the trench; the plate is first formed with two parallel folded portions, which each defines an obtuse angle, and together define an intermediate portion, with the notches and the first upper die; the width of the intermediate portion equals the arc length of the trench; next, the intermediate portion is sandwiched between and pressed with both the second dies to have the same curvature as the trench.

2 Claims, 3 Drawing Sheets

METHOD FOR FOLDING AND CURVING OF A METALLIC PLATE

BACKGROUND OF THE INVENTION

1. Field of the Invention

The present invention relates to a method for folding and curving of a metallic plate, more particularly one, in which a press is used, and a metallic plate is first pressed to have two parallel folded portions each having an obtuse angle and together defining an intermediate portion whose width is equal to the arc length of a trench of a lower die; thus, the intermediate portion will be curved to the same shape as the trench after it is sandwiched between and pressed with the lower die and an upper die fitting the trench, and in turns, two opposing straight portions adjacent to the curved intermediate portion will be parallel.

2. Brief Description of the Prior Art

Referring to FIG. 2, a metallic plate 2 is folded and curved by means of a press so as to have a folded portion 21 on a first edge, and a curved portion 22 adjacent to the folded portion 21. And, the plate 2 is cut to have another curved portion 23 at one end of a second edge thereof, which is adjacent to the first edge. And, the plate 2 is folded along the second edge such that the second edge touches the first one, as shown in FIG. 3. Furthermore, the edges are connected together by means of welding such that the metallic plate 2 has pleasant looking edges, and is suitable for use as a desk.

Referring to FIG. 4, a conventional press is used for folding and curving a metallic plate 2, which includes first and second lower dies 3 and 5, and hydraulic actuated upper dies 4 and 6. The lower die 3 is elongate, and formed with a notch 31 along it while the lower die 5 is elongate, and formed with first and second trenches 51 and 52 along it, whose cross-sections are substantially like an U having a semi-circular bottom or a semi-oval one; the trench 51 is shallower than the trench 52. The upper die 4 is elongate, and formed with a sharp edge along a lower end while the upper die 6 is elongate, and formed with a pressing portion along a lower end and a recess 61 along a lateral side, which pressing portion has such a shape as to fit the trenches 51 and 52 of the second lower die 5.

The metallic plate 2 is first folded to have a first folded portion 21 along a first edge by means of the press with the help of both the notch 31 of the lower die 3 and the sharp lower end of the upper die 4, which first folded portion 21 defines a right angle, as presented with the second drawing in FIG. 4. Next, the metallic plate 2 is curved to have a curved portion 22 next to the first folded portion 21 with the help of the shallow trench 51 and the pressing portion of the upper die 6, as presented with the third and the fourth drawings in FIG. 4; the curved portion 22 has such a shape that the two flat portions adjacent to it aren't parallel with each other, as presented with the fifth drawing in FIG. 4. Then, the curved portion 22 of the plate 2 is sandwiched between and pressed with both the deeper trench 52 of the lower die 5 and the pressing portion of the upper die 6 such that the two straight portions adjacent to it become nearly parallel with each other, as presented with the fifth and the sixth drawings in FIG. 4. And, the metallic plate 2 is folded to have right angles along two ones of the edges that are adjacent to the curved portion 22 also by means of the press with the help of both the notch 31 of the lower die 3 and the sharp lower end of the upper die 4.

The above method is found to have the following disadvantages:

1. The metallic plate has resilience therefore it is difficult to make the metallic plate change to and remain in such a shape that two straight portions thereof that are adjacent to the curved portion are parallel with each other.
2. Because the metallic plate has resilience, the deeper trench 52 of the lower die 5 has to be used otherwise the metallic plate 2 can't be formed with a curved portion having such a shape that the two opposing straight portions of the plate 2 are nearly parallel with each other. In addition, the metallic plate 2 is prone to get damaged if it is formed with the curved portion directly by means of the deeper trench 52 of the lower die 5 without using the shallower trench 51 before. Therefore, the two trenches 51, 52 have to be used in two consecutive pressing actions, and in turns, the worker will face the difficulty of placing the curved portion 22 in the correct position relative to the deeper trench 52 after the curved portion 22 has been formed with the help of the shallower trench 51.
3. Because the two opposing straight portions of the metallic plate 2 on two sides of the curved portion 22 are not exactly parallel with each other, the worker has to press the straight portions manually while he is connecting the edges of the metallic plate by means of welding, facing much trouble. Consequently, it takes more labor to make the metallic plate become a finished product, i.e. a desk.

SUMMARY

It is a main object of the present invention to provide an improvement on a method for folding and curving of a metallic plate to overcome the above disadvantages.

In the method of the present invention, a press is used for folding and curving a metallic plate, which includes first and second lower dies, and first and second hydraulic actuated upper dies. The first lower die has notches along it while the second lower die has a trench along it, whose cross-section is like an U having a semi-circular or semi-oval bottom. The second upper die has a pressing portion fitting the trench. The metallic plate is first formed with two parallel folded portions, which each defines an obtuse angle, and together define an intermediate portion, with the help of the notches and the first upper die; the width of the intermediate portion is equal to the arc length of the trench. Next, the intermediate portion of the metallic plate is sandwiched between and pressed with the second upper and the second lower dies of the press; thus, the intermediate portion has the same curvature as the trench, and the two opposing straight portions adjacent to the curved intermediate portion are parallel.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
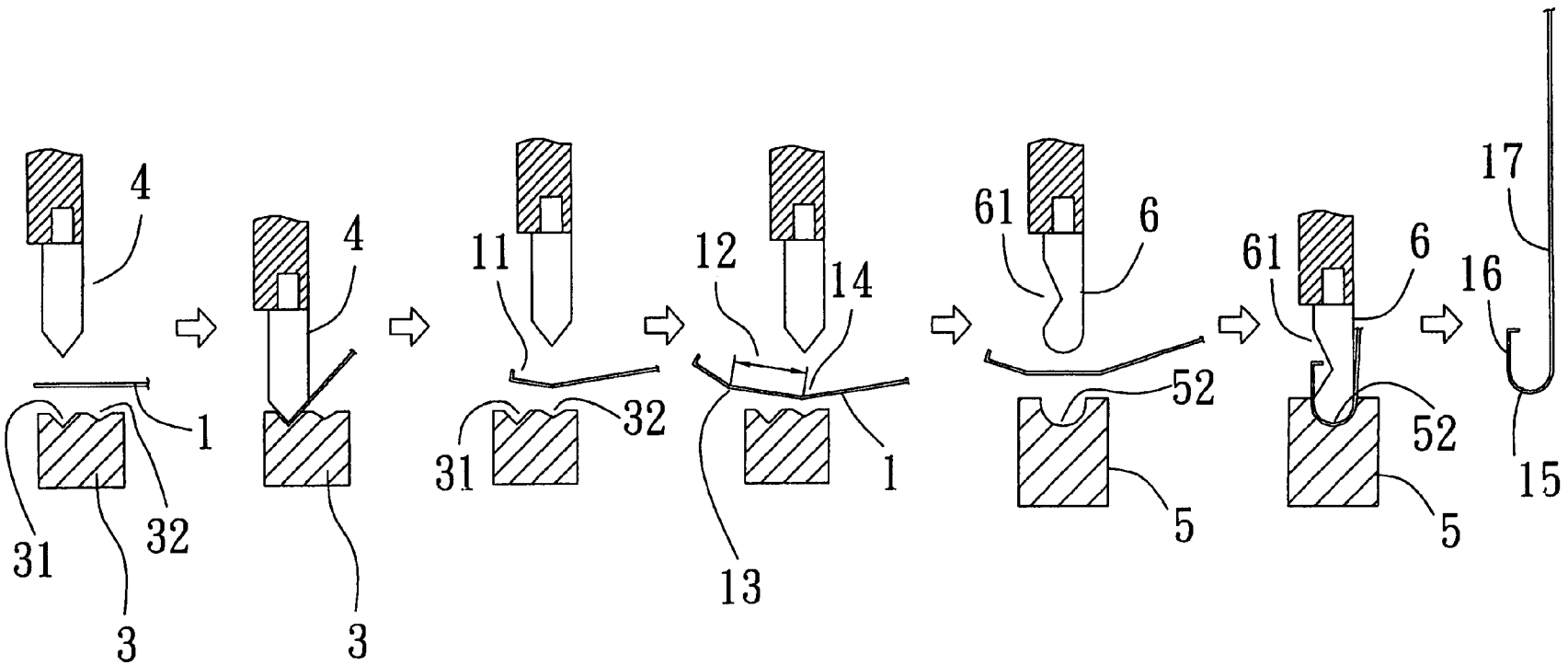
FIG. 1 is a view showing the steps of the method of the present invention.
Figure 2:
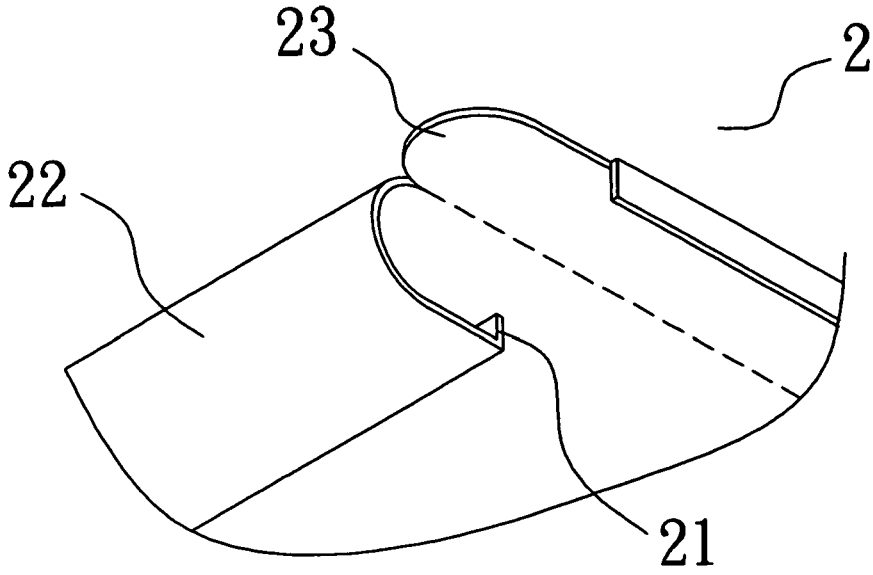
FIG. 2 (PRIOR ART)
FIG. 2 is a perspective view of a folded and curved plate (1)
Figure 3:
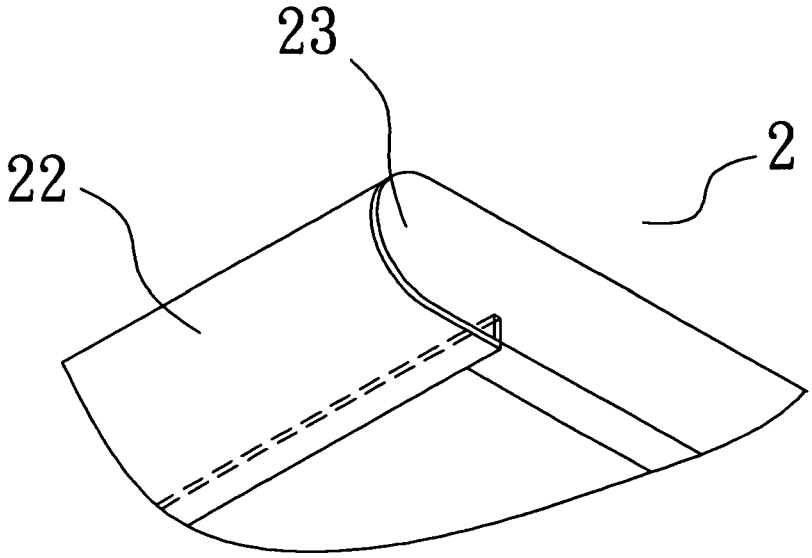
FIG. 3 (PRIOR ART)
FIG. 3 is a perspective view of a folded and curved plate (2)
Figure 4:
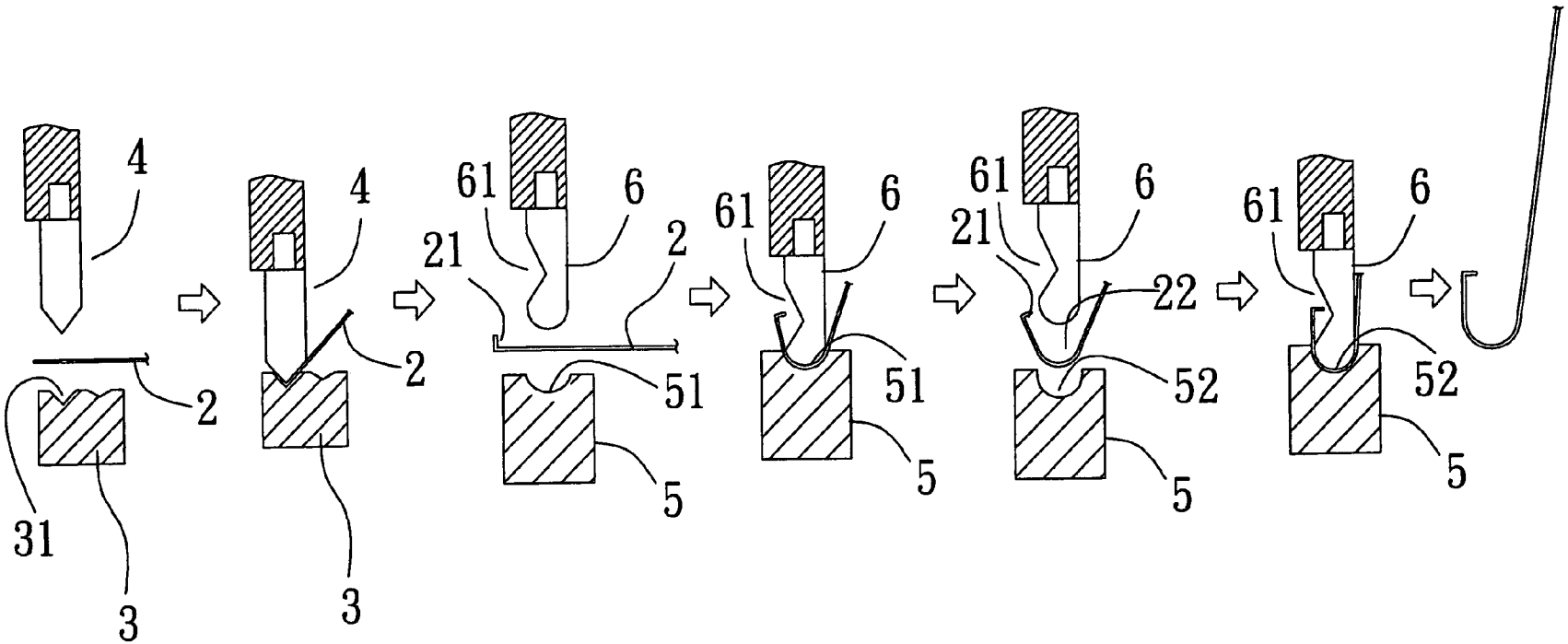
FIG. 4 (PRIOR ART)
FIG. 4 is a view showing the steps of the conventional method for folding and curving of a metallic plate.

Referring to FIG. 1, a preferred embodiment of a method for folding and curving of a metallic plate includes the following steps:

(1) preparing a press, which includes lower dies 3 and 5, and hydraulic actuated upper dies 4 and 6; the lower die 3 being elongate, and formed with first and second notches 31 along it; the lower die 5 being elongate, and formed with a trench 52 along it, whose cross-section is substantially like an U, and can be semi-circular or semi-oval; the upper die 4 being elongate, and formed with a sharp edge along a lower end thereof; the upper die 6 being elongate, and formed with a pressing portion along a lower end thereof as well as a recess 61 along a lateral side thereof, which pressing portion has such a shape as to fit the trench 52 of the lower die 5;

(2) forming a first folded portion 11 along a metallic plate 1 by means of the press with the help of the first notch 31 of the lower die 3 and the sharp lower end of the upper die 4, which first folded portion 11 defines a right angle, as presented with the second drawing in FIG. 1;

(3) forming second and third folded portions 13 and 14 along the metallic plate 1 and parallel with the first folded portion 11 by means of the press with the help of the second notch 32 of the lower die 3 and the sharp lower end of the upper die 4, which second and third folded portions 13 and 14 each defines an obtuse angle, and together define an intermediate portion, as presented with the third and the fourth drawings in FIG. 1; the width of the intermediate portion of the plate 1 being equal to the arc length of the trench 52 of the lower die 5; and (4) curving the intermediate portion of the metallic plate 1 by means of the press with the help of both the trench 52 of the lower die 52 and the lower end pressing portion of the upper die 6 such that the intermediate portion becomes a curved portion 15 along the plate 1, as presented with the fifth to the seventh drawings in FIG. 1; thus, the cross-section of the curved portion 15 has the same shape as that of the trench 52 of the lower die 5, i.e. a semi-circular or semi-oval one, and the two opposing straight portions 16 and 17 of the plate 1, which are on two sides of the curved portion 15, are parallel with each other.

After the above steps, the metallic plate 1 is folded at two ones of the edges that are adjacent to the curved portion 15 also by means of the press with the help of the first notch 31 of the lower die 3 and the sharp lower end of the upper die 4.

From the above description, it can be easily understood that the method of the present invention has the followings advantages over the conventional one:

1. The curved portion 15 of the plate 1 can be formed in a single pressing action instead of two ones because the plate 1 has been formed with the folded portions 13 and 14 before.
2. The folded portions 13 and 14 of the plate 1 can help the worker to place the plate 1 exactly in the proper position before the pressing action is performed to form the curved portion 15. Therefore, the present method will save labor and time.
3. The two opposing straight portions 16 and 17 of the plate 1, which are on two sides of the curved portion 15, will be parallel after the pressing action of step four because the plate 1 has been formed with the folded portions 13 and 14 before. Therefore, the worker won't have press the flat portions 16 and 17 manually while he is connecting the edges of the metallic plate 1 by means of welding, saving a lot of labor and avoiding a lot of trouble. And, the finished product will be smooth and pleasant looking on the joints between the straight portions 16 and 17 and the curved portion 15 thereof.

What is claimed is:

1. A method for folding and curving of a metallic plate, comprising (1) a first step: preparing a press, which includes first and second lower dies, and first and second hydraulic actuated upper dies; the first lower die being elongate, and formed with first and second notches along it; the second lower die being elongate, and formed with a trench along it, whose cross-section is substantially like an U, and is semi-circular; the first upper die being elongate, and formed with a sharp edge along a lower end thereof; the second upper die being elongate, and formed with a pressing portion along a lower end thereof as well as a recess along a lateral side thereof; the pressing portion having such a shape as to fit the trench of the second lower die;

(2) a second step: forming a first folded portion along a metallic plate by means of the press with help of the first notch and the sharp lower end of the first upper die;

(3) a third step: forming second and third folded portions along the metallic plate and parallel with the first folded portion by means of the press with help of the second notch and the sharp lower end; each of the second and the third folded portions having an obtuse angle; both of the obtuse angles of the metallic plate together defining an intermediate portion between them whose width is equal to an arc length of the trench of the second lower die; and (4) a fourth step: curving the intermediate portion of the metallic plate by means of the press with help of both the trench of the second lower die and the pressing portion of the second upper die such that the intermediate portion has a same curvature as the trench.

2. The method as claimed in claim 1, wherein the cross-section of the trench of the second lower die is semi-oval instead of semi-circular.

* * * * *